US005341718A

United States Patent [19]

Woodall, Jr. et al.

[11] Patent Number: 5,341,718

[45] Date of Patent: Aug. 30, 1994

[54] LAUNCHED TORPEDO DECOY

[75] Inventors: Robert C. Woodall, Jr., Pasadena; S. Kyle Jones, Hyattsville; H. Joseph Jones, Jr., Elkridge, all of Md.

[73] Assignee: The United States of America as represented by the Secretary of the Navy, Washington, D.C.

[21] Appl. No.: 110,257

[22] Filed: Aug. 19, 1993

[51] Int. Cl.[5] ..... B63G 9/00

[52] U.S. Cl. ..... 89/1.11; 102/377

[58] Field of Search ..... 89/1.11, 1.51; 102/377, 102/348

[56] References Cited

U.S. PATENT DOCUMENTS

| | | | |
|---|---|---|---|
| 1,300,413 | 4/1919 | Kee | 89/1.11 |
| 3,056,351 | 10/1962 | Bares | 102/340 |
| 4,215,630 | 8/1980 | Hagelberg et al. | 89/1.11 |
| 4,993,344 | 2/1991 | Jones | 89/1.11 |
| 5,012,717 | 5/1991 | Metersky et al. | 89/1.11 |
| 5,069,109 | 12/1991 | Lavan | 89/1.11 |
| 5,153,366 | 10/1992 | Lucas | 89/1.11 |

*Primary Examiner*—David Brown

*Attorney, Agent, or Firm*—Jacob Shuster

[57] ABSTRACT

An acoustic decoy round ejected by a launcher for flight above water from a sea-going vessel, impacts at the water surface to cause separation of a payload from a forward section of the round that is also separated from a flotation anchor tethered to the payload and fins which stabilized launched flight of the round prior to impact. The separated payload submerges from the flotation anchor at the water surface location to a tethered depth within the water from which a decoy signal is emitted.

10 Claims, 6 Drawing Sheets

LAUNCHED TORPEDO DECOY

BACKGROUND OF THE INVENTION

This invention relates generally to acoustic devices launched from marine seagoing vessels or the like.

Expendable acoustic devices are presently available for deployment into seawater to counter torpedoes targeted at naval submarines. Currently, naval surface ships deploy torpedo decoys for submarines by manually activating and throwing the acoustic devices overboard. Such manual deployment of acoustic devices from surface vessels is often excessively time consuming, difficult to perform under high sea conditions, and often inadequate because of separation between the ship and the final deployment location of the acoustic device in the water.

It is therefore an important object of the present invention to provide for deployment of acoustic devices from sea-going surface vessels by use of missile launchers.

In accordance with the foregoing objective, it is a more particular object of the present invention to provide a transport round for launch of an acoustic type payload from existing mortar or rocket launchers on naval surface vessels, whereby safe, rapid and effective deployment of a torpedo decoy is achieved.

SUMMARY OF THE INVENTION

In accordance with the present invention, a decoy round is ejected from a missile launcher for travel through the air to a location at which it impacts with the water surface. The decoy round includes aft and forward sections that are separable upon water surface impact. An acoustic payload carried within the forward section of the round is thereby displaced from its enclosure and sinks to a depth at which acoustical decoy signals are emitted therefrom. The payload is tethered to a flotation anchor inflated and released from a separated section of the round at the water surface impact location.

The aft section of the round is provided with fins projected therefrom upon exit of the round from the launching tube to stabilize flight before impact. Safety arming means within the aft section is also rendered operative upon launch of the round to enable subsequent separation of its sections and impact responsive inflation of the flotation anchor by explosive charges carried by the round. Also, the safety means maintains the explosives within the round out of line for safe handling prior to launch.

BRIEF DESCRIPTION OF THE DRAWING FIGURES

Other objects, advantages and novel features of the invention will become apparent from the following detailed description of the invention when considered in conjunction with the accompanying drawing wherein.

DETAILED DESCRIPTION OF PREFERRED EMBODIMENTS

Figure 1:
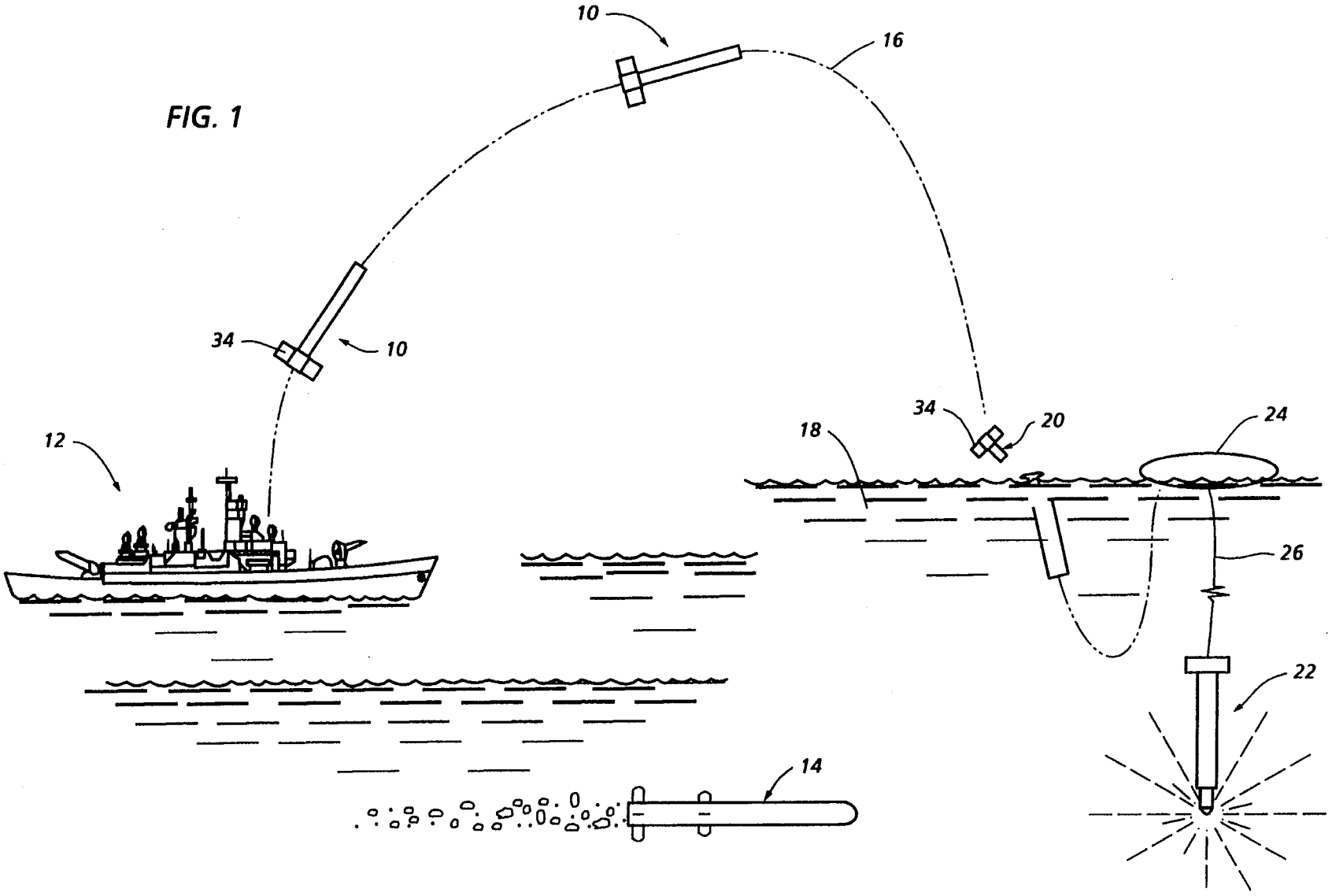
FIG. 1 is a somewhat simplified side elevation view illustrating deployment of an acoustic torpedo decoy in accordance with one embodiment of the present invention.

Referring now to the drawing in detail, FIG. 1 illustrates the deployment of a decoy round 10 launched from a naval surface vessel 12 by a mortar launching system of a well known type, according to one embodiment of the invention, as a countermeasure to an underwater torpedo 14. The round 10 when launched travels along a trajectory 16 through the air for some distance from the vessel 12 to impact on the surface of the water 18 causing the aft end section 20 of the round to separate. Separation of round sections as a result of impact also releases an expendable acoustic payload 22 of a generally known type and a flotation anchor 24. The payload 22 remains connected to the anchor 24 by a tether 26, and sinks to a depth predetermined by the length of the tether. Upon reaching such tethered depth, the submerged payload 22 is buoyed in the water while emitting an acoustic decoy signal in the form of a discreet broadband noise, for example, in order to divert the underwater torpedo 14 away from the surface vessel 12 being targeted.

Figure 2:
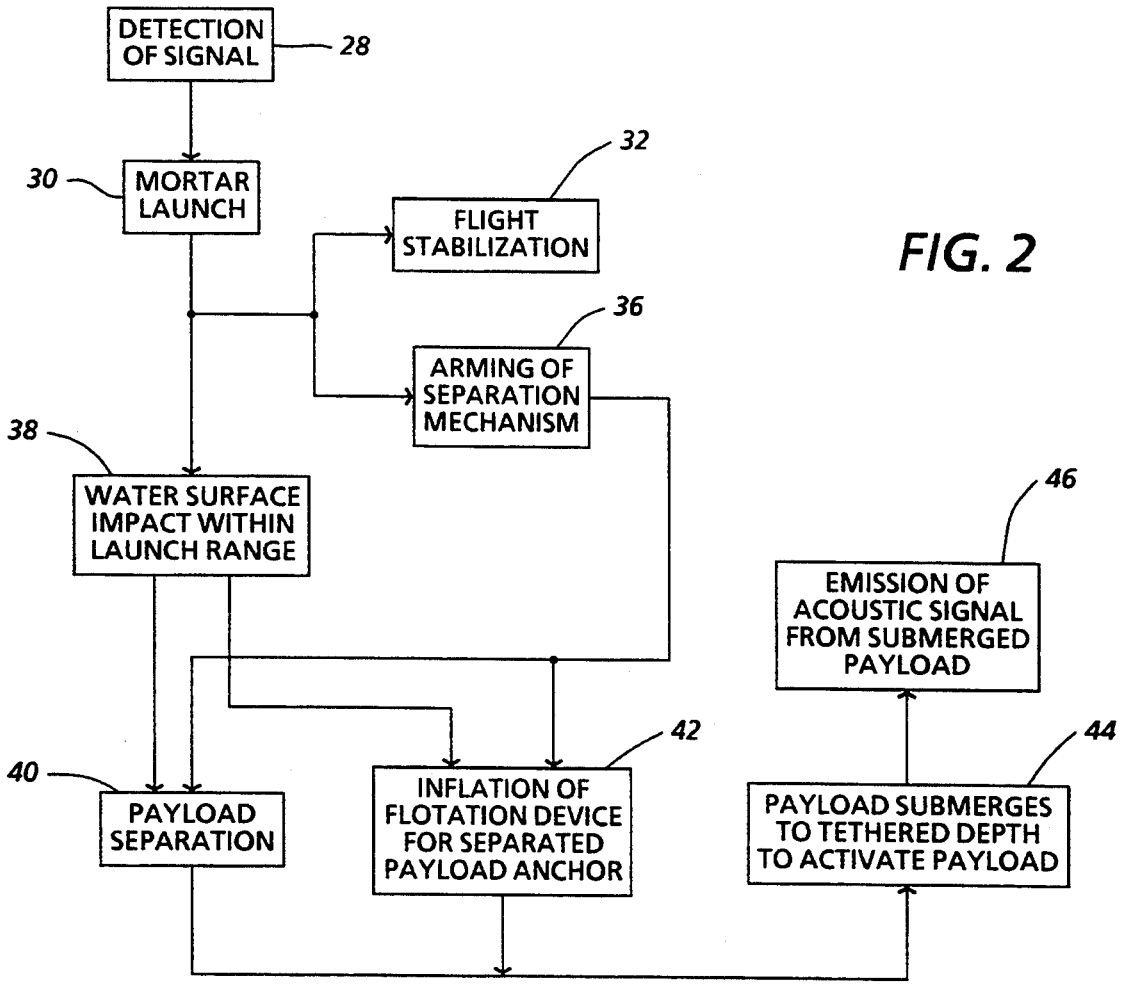
FIG. 2 is a functional block diagram of the deployment program associated with the present invention.

FIG. 2 diagrams the operational deployment program associated with the decoy round 10, as hereinbefore outlined. The deployment program is initiated by detection of a signature signal reflecting approaching torpedo 14 or the like within the vicinity of the ship 12, as denoted by block 28 in FIG. 2. Such signal detection step 28 triggers launch which was heretofore manually controlled. Such launch of round 10 by a conventional mortar launcher as hereinafter referred to and diagrammed by block 30 in FIG. 2, initiates flight stabilization denoted by block 32, involving projection of fins 34 from the aft end section 20 of the round 10. At the same time, arming of a separation mechanism in the round, as denoted by block 36, is effected to enable subsequent payload separation and inflation of anchor 24.

Upon impact of the water surface within the range associated with the launch system, as denoted by block 38 in FIG. 2, separation of the payload 22 occurs as denoted by block 40 while the flotation anchor 24 is inflated as indicated by block 42. The payload then sinks to its tethered depth below anchor 24 at which the hydrostatic pressure environment activates the payload as denoted by block 44, to trigger emission of an acoustic signal as denoted by block 46, for decoying purposes.

Figure 3:
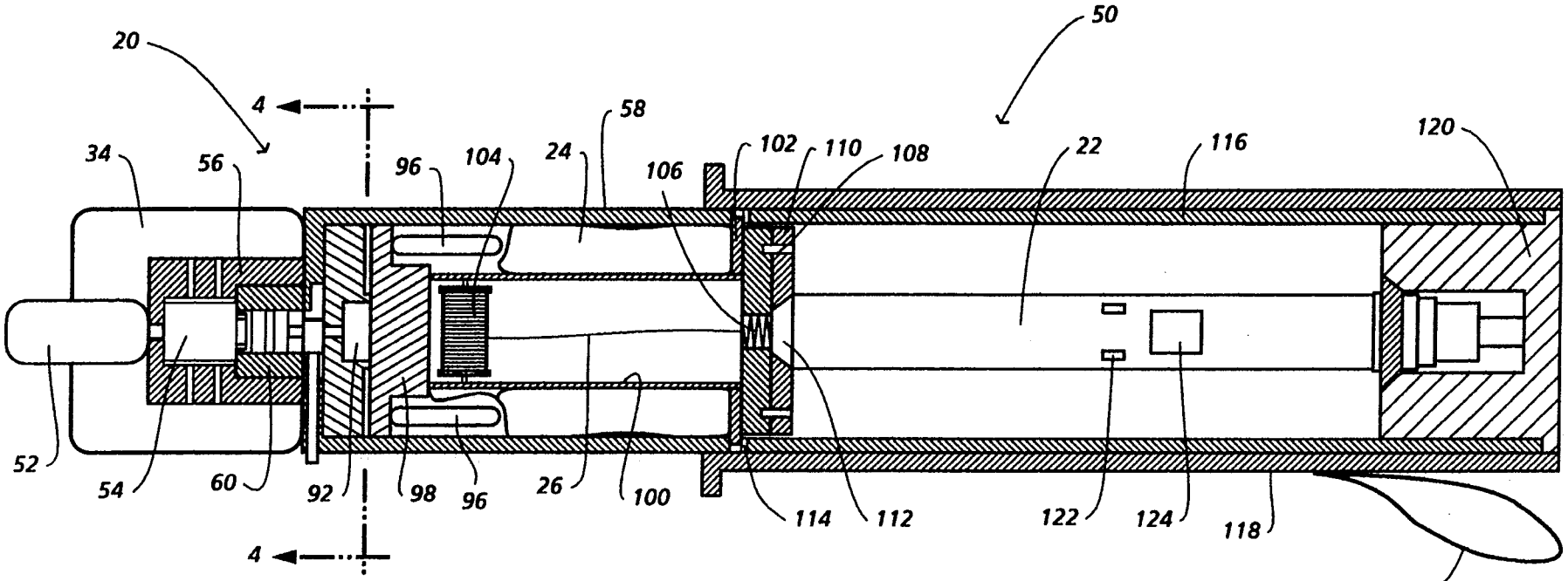
FIG. 3 is a side section view through a decoy round as shown in FIG. 1, prior to launch.
Figure 5:
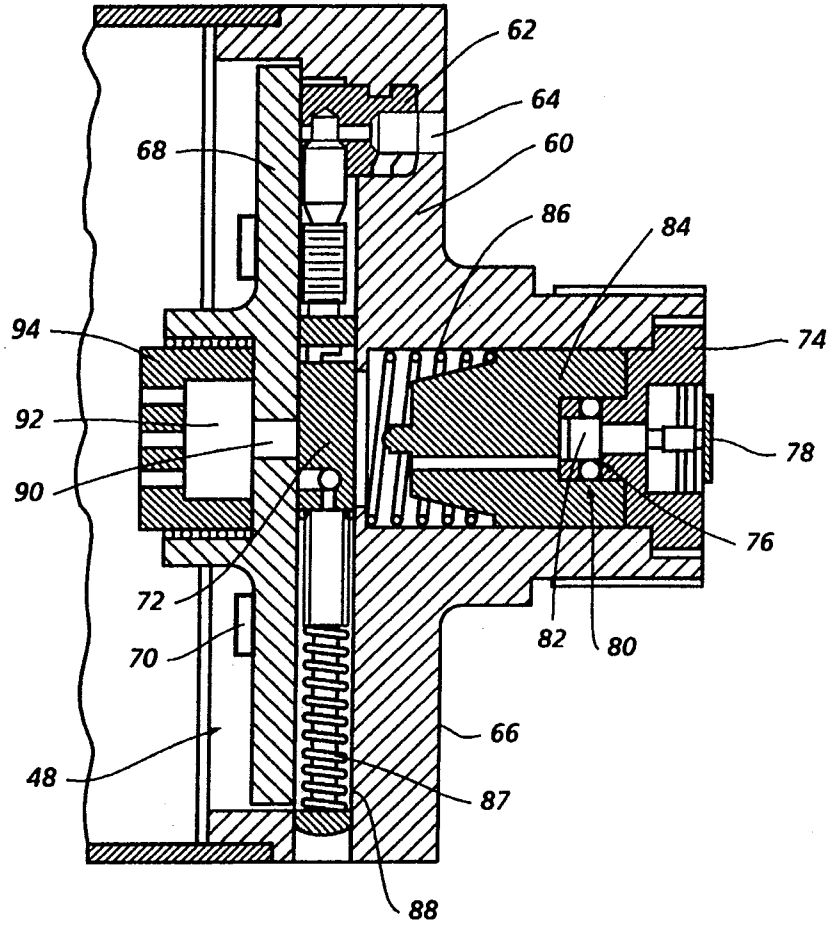
FIG. 5 is a partial section view taken substantially through a plane indicated by section line 5—5 in FIG. 4.
Figure 4:
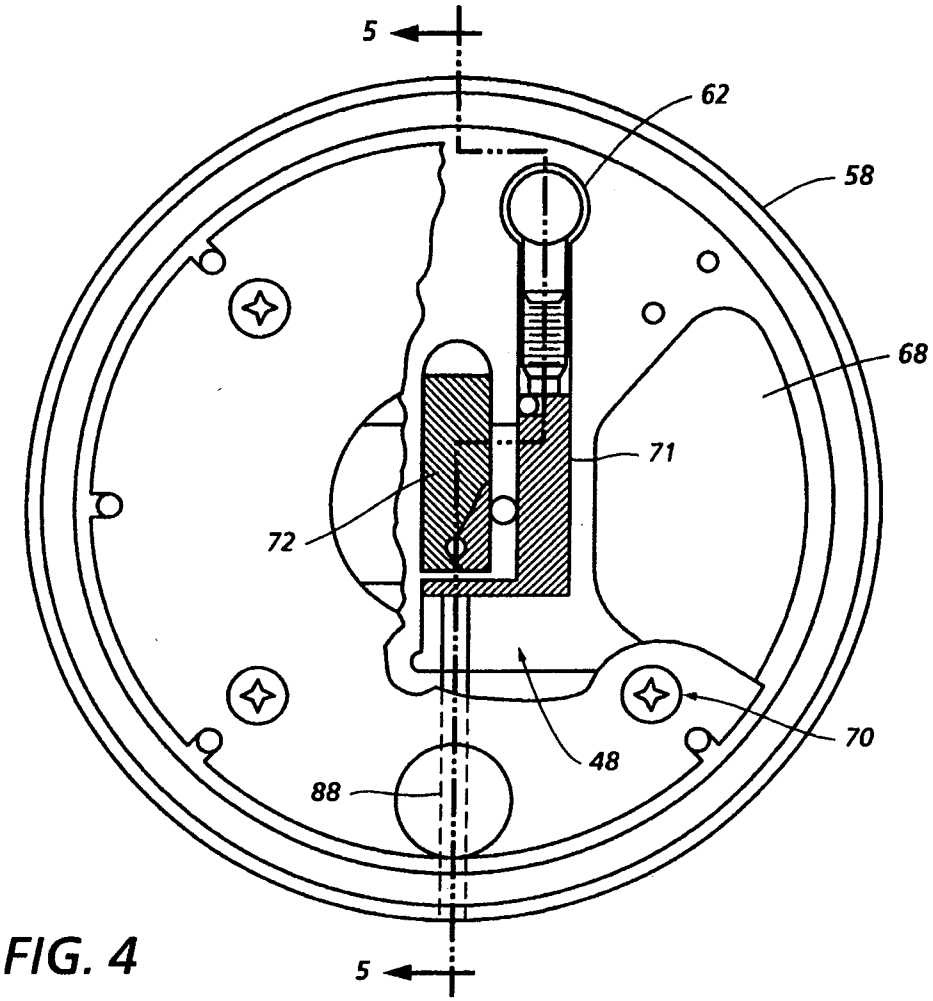
FIG. 4 is an enlarged transverse section view taken substantially through a plane indicated by section line 4—4 in FIG. 3.

FIGS. 3, 4 and 5 illustrate in greater detail the decoy round 10 before launch. The decoy round comprises separable enclosure sections including the aforementioned aft end section 20 and forward section 50. The aft end section 20 encloses the aforementioned flotation anchor 24 and separation mechanism 48. The forward section 50 encloses the aforementioned payload 22. Upon launch, the fins 34 are projected from the aft end section 20 as aforementioned to stabilize flight of the round along its trajectory 16. The separation mechanism 48 as shown in FIGS. 4 and 5 is also armed during launch in preparation for completed deployment of the round 10 following its impact with the water surface, as explained in detail hereinafter.

Referring now to FIGS. 3 and 5 in particular, the aft end section 20 of the decoy round 10 includes a rearwardly projecting firing coil 52 located centrally within the assembly of fins 34. The launcher begins operation in a well known mortar launching manner by energizing the coil 52 so as to forwardly fire a squib therefrom into a propellant charge 54 enclosed within a support housing 56 carrying the fins 34 attached to a small diameter holder extension 60 of a tubular housing 58 of the aft end section 20. The resulting ignition of the propellant charge 54 exerts a forward thrust on the tubular housing 58 through its holder extension 60 to which the support housing 56, enclosing the propellant charge 54, is threadedly connected. Expansion of gases from the ignited propellant charge inside of the launcher exerts pressure on the round to exert forward propelling thrust thereon.

As more clearly seen in FIGS. 4 and 5, the separation mechanism 48 includes a bellows assembly 62 which is extended radially inwardly of the holder extension 60 by the propellant gas pressure entering opening 64 therein on rear end face 66, opposite a plate 68 mounted on the holder extension by a plurality of screw fasteners 70. A cocking bar 71 is thereby displaced by the bellows assembly to release a slider 72 from plate 68 in preparation for subsequent arming of the payload. Propellant gas pressure is also exerted on an arming disk 74 slidably mounting a piston 76, having a shield disk 78 at its rear end. The arming disk 74 and piston 76 are disposed within the holder extension 60 at its forward end. Locking ball bearing elements 80 in engagement with the inner end portion 82 of the piston 76 hold the arming disk axially fixed to an inertial firing pin 84 slidably mounted in the holder extension 60 under the bias of an anti-creep spring 86. Thus, inward displacement of the piston 76 by the propellant gas pressure, as aforementioned, releases the firing pin 84 from the arming disk 74 for subsequent axial displacement relative to the holder extension 60. When the round emerges from the barrel of the launcher, a rider 87 is free to be displaced radially outward from a bore 88 in the holder extension 60 to complete arming of the payload by displacement of slider 72, while the fins 34 are forced open by the sudden pressure differential at the launching barrel exit.

Upon subsequent water impact of the round 10, the firing pin 84 is thrust forwardly against the bias of spring 86 into the space opened by displacement of the slider 72 to expose a stab primer 90 in the plate 68. In response to the firing pin 84 striking the primer 90, a separation charge 92 within retainer 94 threadedly mounted on the forward face of the plate 68, is fired. The pressure generated by firing of charge 92 separates the aft section 20 and punctures two bottles 96 of pressurized $CO_2$ gas positioned within the tubular housing 58 by rear end wall support 98 located forwardly of the deflated anchor floats 24, as shown in FIG. 3. The anchor floats and gas bottles 96 are furthermore positioned about a tubular support sleeve 100 fixed to end wall support 102 of the decoy round. The sleeve 100 extends axially from end wall support 102 into abutment with the opposite end wall support 98 and rotatably mounts therein a tether spool 104 in spaced adjacency to end wall support 98. The tether cord 26 extends from spool 104 through the end wall support 102 for connection to the rear end of the payload 22 within the forward end section 50 of the decoy round as shown in FIG. 3.

With continued reference to FIG. 3, the rear end of payload 22 abuts the end wall support 102 and is held in coaxial alignment therewith by rubber supports 108 projecting into the end wall support from a support disc 110 having a conical opening within which the rear end portion 112 of the payload is seated. The support disc 110 is axially positioned within a sleeve 116 protectively enclosing the payload 22 within the forward end section 50, to which the end wall support 102 is connected by shear screws 114. An outer extender tube 118 having a handle 119 attached thereto is clamped to the launcher and remains attached thereto during launch so as to enclose the sleeve 116 and project axially therebeyond over the tubular housing 58 of the round prior to launch. An end support body 120 at the forward end holds the protective sleeve 116 assembled to the round, as shown, prior to water impact.

The screws 114 are sheared by the aforementioned generation of pressure in response to firing of the separation charge 92 to separate the forward section 50 from the round. Upon separation of the forward section 50, the expansion of gas from the punctured bottles 96 inflates the anchor floats 24 which are thereby buoyed to the water surface as diagrammed in FIG. 1. The separated forward section 50 then sinks as the tether spool 104 pays out the tether line 26 with the payload 22 being impelled for displacement forwardly from its enclosing sleeve 116 by the thrust of separation spring 106 shown in FIG. 3. With the payload 22 submerged, the seawater under pressure enters inlets 122 in order to activate the payload by wetting of its seawater battery 124. Accordingly, when the payload reaches it tethered depth a hydrostatic seawater pressure switch enables the payload to begin producing the acoustic signature signal for torpedo decoying purposes.

Figure 6:
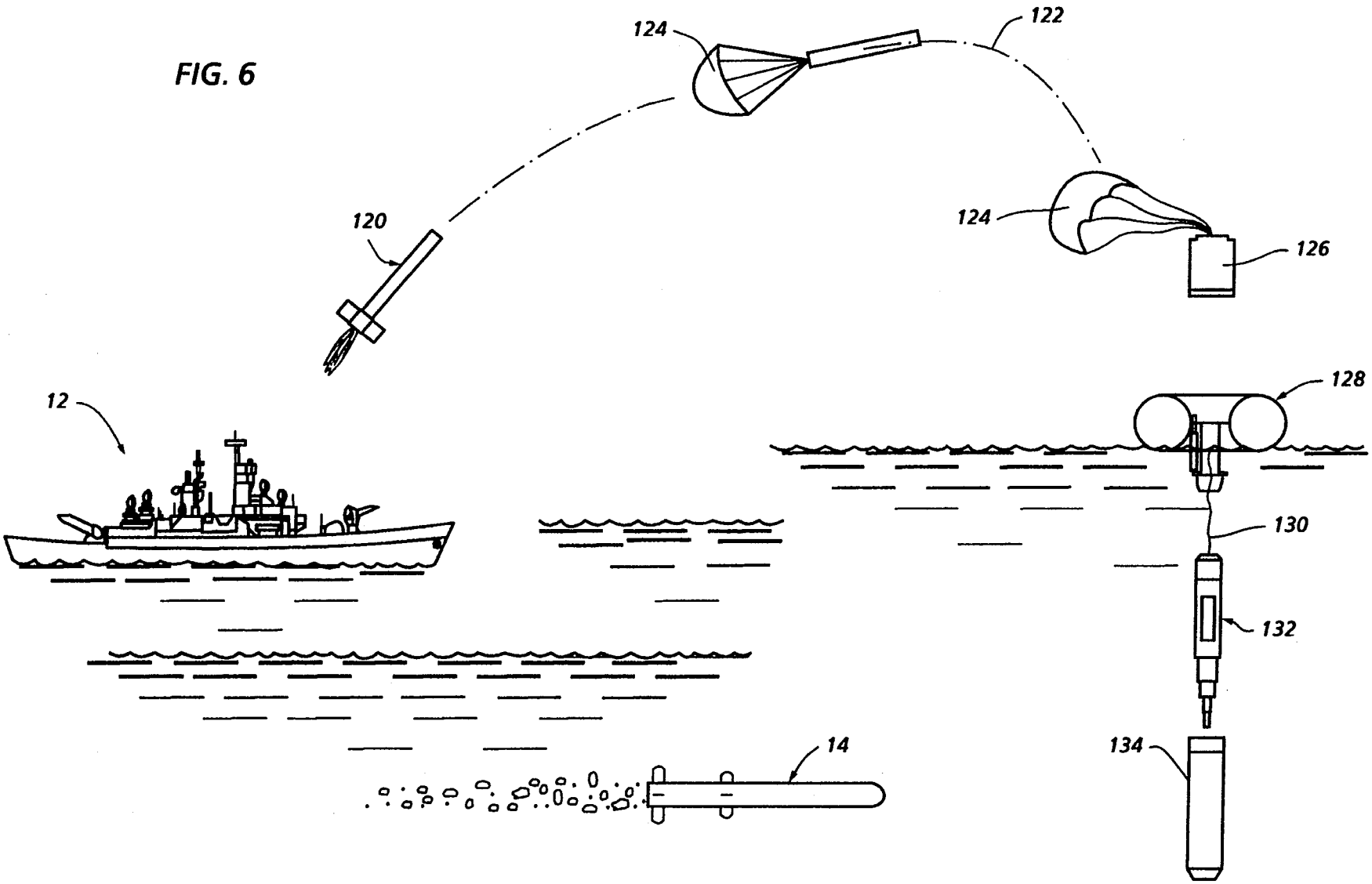
FIG. 6 is a simplified side elevation view illustrating deployment of an acoustic torpedo decoy in accordance with another embodiment of the invention.

According to another embodiment of the invention as diagrammed in FIG. 6, a rocket propelled type of decoy round 120 is launched from naval surface vessel 12 as a countermeasure to underwater torpedo 14. The round 120 when launched travels along a trajectory 122 from vessel 12 through the air a distance greater than the mortar range depicted in FIG. 1 to an impact location on the surface of the water 18. At a selected point along its trajectory 122, the rocket propelled decoy round 120 releases a parachute 124 to stabilize continued travel. Parachute releasing devices for such purposes are per se well known in the art, as disclosed for example in U.S. Pat. No. 3,056,351 to Bares.

With continued reference to FIG. 6, an aft end section 126 of the decoy round 120 is depicted as separated at the water surface impact location. The previously deployed parachute 124 attached to the aft end section 126 assures that it does not interfere with the remaining portion of the round 120 from which a flotation anchor assembly 128 is also separated and inflated as shown in a manner similar to the deployment of the flotation anchor 24 hereinbefore described. A tether line 130 extends a pay-out distance from the flotation anchor device 128 to the aft end of a payload 132 separated from a shell carriage portion 134 of the deployed decoy round 120. As hereinbefore described with respect to the payload 22 in FIG. 1, the payload 132 is activated by seawater hydrostatic pressure when it sinks to a predetermined tethered depth. When activated, the payload 132 emits the decoy signal as a countermeasure to the approaching torpedo 14.

Figure 7:
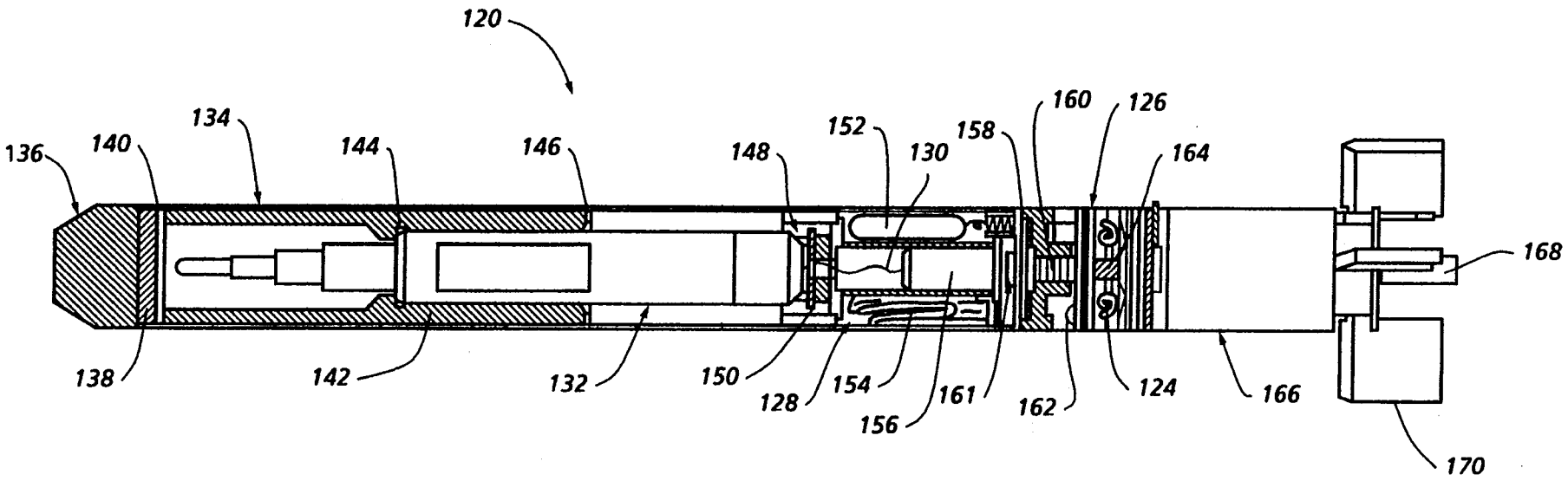
FIG. 7 is a side section view through a decoy round as shown in FIG. 6.

FIG. 7 depicts in greater detail the decoy round 120 just after launch. The payload 132 as shown is enclosed in the carriage shell 134 aforementioned, having a nose 136 at its forward end. The nose 136 is spaced by a shock mount 138 from an end plate 140 interconnected with rearwardly extending carriage rails 142 supporting the payload 132 between axially spaced positioning ring 144 and carriage ring 146 in the forward end section. The rear end of the payload from which the tether cord 130 extends, abuts an aft support ring 148 spaced by shock mount 150 from the floatation anchor assembly 128, also mounted with the carriage shell 134 of the forward end section of the round. The $CO_2$ bottles 152 within shell 134 supply the pressurized gas to inflate the floats 154 of the flotation anchor assembly 128, which also includes the tether spool device 156 from which the tether cord 130 pays out.

The carriage shell 134 is separated from the aft end section 126 by the separation charge 158 at its forward end, in response to displacement of firing pin 160 engaging percussion detonator 161 under control of electronics assembly 162, which also controls ejection of the parachute 124 by ignition of the separation charge 164. Ignition of the separation charge 164 also separates the rocket motor assembly 166 from the aft end of the round which is in turn ignited during launch through coil assembly 168 to initially propel the round along its trajectory 122. The fins 170 are at the same time projected from the aft end of the round while being propelled by the rocket motor assembly to stabilize flight along the trajectory.

Numerous other modifications and variations of the present invention are possible in light of the foregoing teachings. It is therefore to be understood that within the scope of the appended claims the invention may be practiced otherwise than as specifically described.

What is claimed is:

1. In combination with a launching system, a decoy round adapted to be deployed from a marine vessel, including: aft and forward sections interconnected with each other, fin means mounted on the aft section for flight stabilization of the round during travel above water from the vessel, separation means responsive to impact of the round with the water upon completion of said travel thereof for separating the sections of the round from each other, payload means within the forward section of the round for generating an acoustical signal in response to submergence thereof within the water following said separation of the sections of the round, flotation means mounted within the round and inflated in response to said impact with the water for anchoring the payload means and tethering means connecting the flotation means to the payload means for limiting said submergence thereof while anchored by the flotation means to a predetermined depth at which the acoustical signal is emitted.

2. The decoy round as defined in claim 1, including spring means for displacement of the payload means from the forward section in response to said separation of the sections from each other.

3. The decoy round as defined in claim 1, including arming means responsive to launch from the vessel for enabling the separation means.

4. The decoy round as defined in claim 3, including spring means for displacement of the payload means from the forward section in response to said separation of the sections from each other.

5. In a system for launching an acoustical decoy from a marine vessel in response to detection of approach of an underwater torpedo, a program for deployment of the decoy including the steps of: simultaneously stabilizing flight of the decoy and enabling operation thereof in response to powered launch from the vessel; separating the decoy into a flotation anchor and a payload in response to impact of the decoy with water upon completion of said flight thereof; and emitting acoustical signals from the separated payload in response to submergence thereof to a tethered depth within the water below the flotation anchor.

6. In combination with a system for propelling a powered signaling device to a water surface location, enclosure means for protectively transporting said signaling device during travel thereof, means carried by the enclosure means for stabilizing said travel of the signaling device to the water surface location, explosive means responsive to impact of the enclosure means at said water surface location for separating the signaling device from the enclosure means and flotation anchoring means mounted by the enclosure means and connected to the signaling device for limiting submergence thereof to a tethered depth below said water surface location.

7. The combination of claim 6 including safety arming means within the enclosure means for enabling said explosive means and the flotation anchoring means in response to launch.

8. The combination of claim 7 wherein said means for stabilizing includes fins projected during said travel of the enclosure means.

9. The combination of claim 8 wherein means for stabilizing said travel further includes a parachute deployed from the enclosure means prior to said impact thereof at the water surface location.

10. The combination of claim 9 wherein the system for propelling includes a rocket motor from which the fins are projected.

* * * * *